US006390864B1

(12) United States Patent
Jenkins

(10) Patent No.: US 6,390,864 B1
(45) Date of Patent: May 21, 2002

(54) OUTBOARD MOTOR POSITIONER

(76) Inventor: Edwin E. Jenkins, 3916 W. 228$^{th}$ Pl., Torrance, CA (US) 90505

( * ) Notice: Subject to any disclaimer, the term of this patent is extended or adjusted under 35 U.S.C. 154(b) by 0 days.

(21) Appl. No.: 09/603,399

(22) Filed: Jun. 26, 2000

(51) Int. Cl.$^{7}$ ..... B63H 20/08; B63H 5/125; B63H 5/20

(52) U.S. Cl. ..... 440/53; 248/640

(58) Field of Search ..... 123/195 P; 248/640, 248/641, 642, 643; 440/53, 54, 63, 6

(56) References Cited

U.S. PATENT DOCUMENTS

| | | | | | |
|---|---|---|---|---|---|
| 2,740,602 | A | * | 4/1956 | Kloss | 248/643 |
| 2,782,744 | A | * | 2/1957 | Staley | 440/63 |
| 2,901,194 | A | * | 8/1959 | Shontz | 248/642 |
| 2,905,132 | A | * | 9/1959 | Lewis et al. | 440/63 |
| 3,063,404 | A | * | 11/1962 | Jones | 440/53 |
| 3,342,156 | A | * | 9/1967 | Rayner et al. | 440/63 |
| 3,567,164 | A | * | 3/1971 | Hakala | 440/63 |
| 3,648,645 | A | * | 3/1972 | Ezell | 440/63 |
| 3,948,472 | A | | 4/1976 | Metcalf | |
| 4,279,602 | A | * | 7/1981 | Alter | 440/63 |
| 4,498,872 | A | * | 2/1985 | Stonley et al. | 440/63 |
| 4,668,197 | A | * | 5/1987 | Proto | 440/54 |
| 5,522,578 | A | * | 6/1996 | Mayfield | 248/642 |

FOREIGN PATENT DOCUMENTS

| | | | | |
|---|---|---|---|---|
| DE | 3723481 | * | 1/1989 | 440/63 |

* cited by examiner

*Primary Examiner*—S. Joseph Morano
*Assistant Examiner*—Andrew Wright

(57) ABSTRACT

A mechanical assembly for supporting and positioning an outboard motor (44) in two primary positions. The first position is on deck (40) near the transom, a relatively safe position for attaching or removing an outboard motor while at sea. The second position is on the transom (42), in a marine propulsion operational position, with the propeller in the water. In the preferred embodiment of the positioner an outboard motor (44) is mounted to a mounting board (30) that is part of a car assembly (20) that slides in a captivated track adapted for mounting to the deck (40) and the transom (42). The track is a single continuous track from deck to transom facilitating positioning of the outboard motor in either of the two primary positions. In the alternate embodiment of the positioner the outboard motor can be positioned between the same two positions, on deck (40) and on the transom (42). The mechanism for spatial positioning using the alternate embodiment is a five-section series hinge. The two end sections (52) and (60) are adapted for mounting to the deck (40) and the transom (42) respectively. The middle section of hinge (56) has a bracket (72) and mounting board (30) incorporated to provide mounting for the outboard motor (44). The middle (56), and two adjacent sections (54) and (58) of hinge, facilitate controlled positioning of the outboard motor between the two primary positions. In both the preferred and alternate embodiments of this outboard motor positioner, the outboard motor (44) can be easily moved in a controlled manner to either position.

2 Claims, 4 Drawing Sheets

OUTBOARD MOTOR POSITIONER

CROSS-REFERENCE TO RELATED APPLICATIONS

Not Applicable

BACKGROUND: FIELD OF TECHNOLOGY

This invention relates to supporting and positioning an outboard motor on a boat, while facilitating its travel between an on-deck position just forward of the transom and the lower side of the transom.

BACKGROUND: DESCRIPTION OF RELATED ART

Outboard motors are useful for the propulsion of sailboats in the range of approximately 18 to 33 feet in overall length. Sailboats smaller than approximately 18 feet do not normally require an outboard motor for transit or maneuvering. Sailboats larger than 33 feet in overall length usually have an inboard motor, because attaching or removing an outboard motor powerful enough to propel such a boat is not practical due to the larger size and weight of the motor.

It is important to be able to safely attach and secure or remove and store an outboard motor while at sea. Using one of the typical outboard motor brackets available today, the attachment or removal process require the boater to hang over the stem of the boat and support the weight of the outboard motor while positioning and attaching it. This is an awkward process that puts both the boater and the outboard motor at high risk of either one or both falling overboard, especially if at sea where boat stability is rare.

Inventions of others have solved the problem of lowering or lifting the propeller end of an outboard motor in to or out of the water by utilizing apparatus that can move an outboard motor up and down, or tilt it, or a combination of both, however they have not solved the problem above, i.e., provide means for safely attaching or removing an outboard motor while at sea.

SUMMARY

While at sea, where stability is rare, attaching and securing or removing and storing an outboard motor to a bracket or other apparatus on the transom of a boat is difficult. It presents a substantial risk for both the boater and the motor falling overboard.

Many sailboats from approximately 18 to 33 feet in overall length use an outboard motor to facilitate transit or maneuvering, especially when the wind is very light or very heavy with the sails doused.

An experienced Skipper of a racing sailboat does not want to have an outboard motor protruding from the back of the sailboat during a race for two reasons. First, having more weight at the end of the boat increases the moment of inertia. This increased moment of inertia increases the hobby-horsing motion, making the boat sail slower. Second, the protrusion of the outboard motor from the transom presents a collision hazard while in traffic. For these reasons alone, it is very desirable to be able to safely attach and secure or remove and stow an outboard motor while at sea.

This invention, outboard motor positioner, facilitates the attachment and securing or removal operation of an outboard motor on deck where it is relatively safe, as opposed to the awkward position of reaching over the transom and risking both the boater and the outboard motor falling overboard.

The outboard motor positioner also facilitates moving the outboard motor easily from a safe, on-deck position to a normal marine propulsion operating position near the bottom of the transom.

BRIEF DESCRIPTION DRAWINGS

FIG. 1 is a perspective view of the preferred embodiment of a positioner showing a track, a car and an outboard motor mounting board. The car-mounting board assembly is shown in the marine propulsion operational position. An outboard motor is not shown in this view to more clearly show the components of the positioner.

Figure 1:
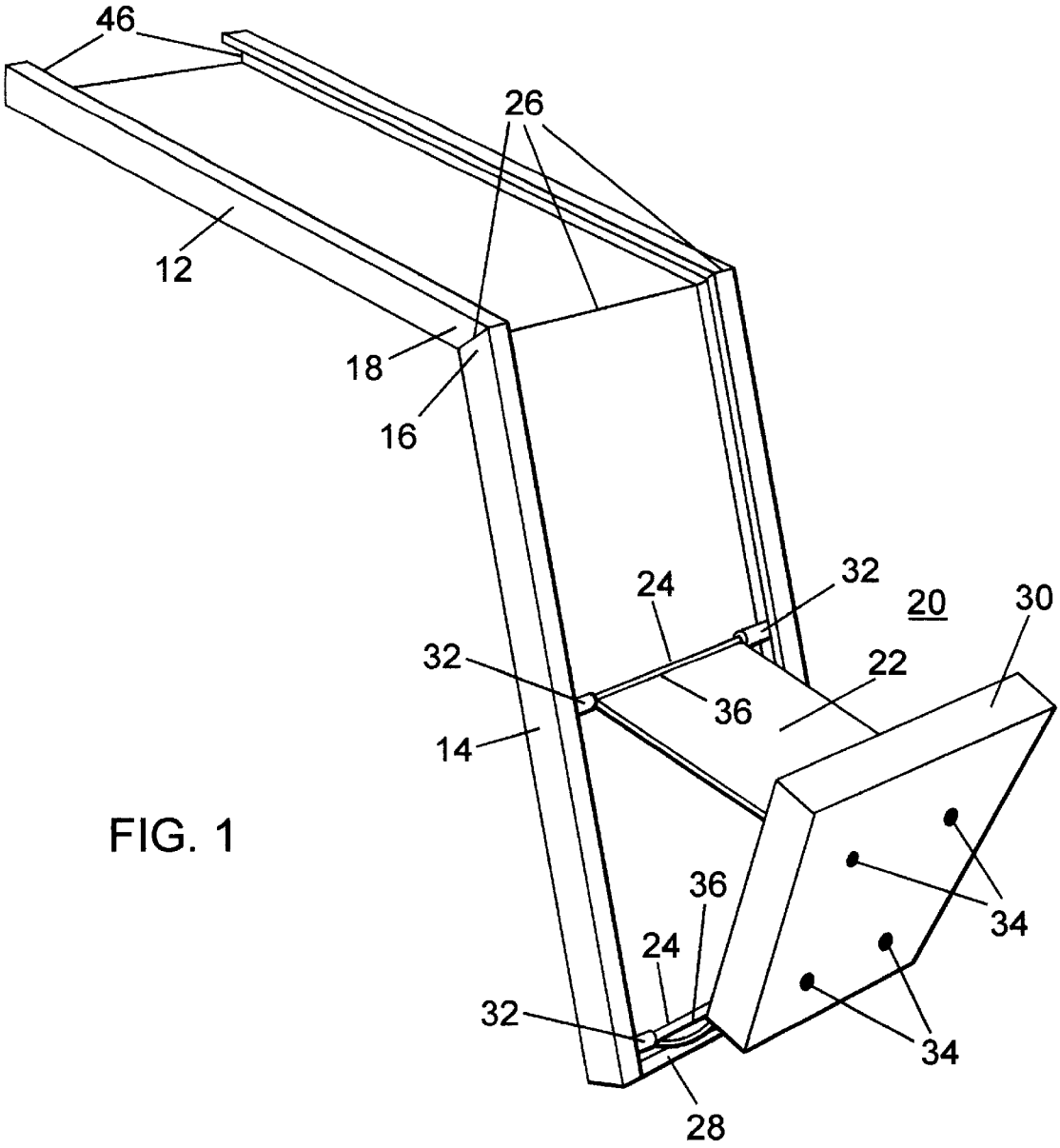

Before explaining the invention in detail, it is to be understood that the invention is not limited in its application or to the detail of construction and the arrangement of components set forth in the following descriptions or illustrated in the drawings. The invention is capable of other embodiments and of being practiced and carried out in various ways. Also, it is to be understood that the phraseology and terminology employed herein is for the purpose of description and should not be regarded as limiting.

DETAILED DESCRIPTION OF THE INVENTION

The outboard motor positioner is comprised of three major components.

Figure 2:
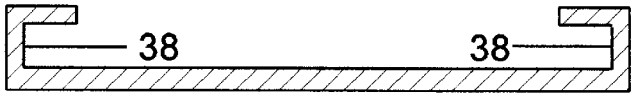
FIG. 2 is a cross-sectional view of the extrusion used for fabricating the track.
Figure 3:
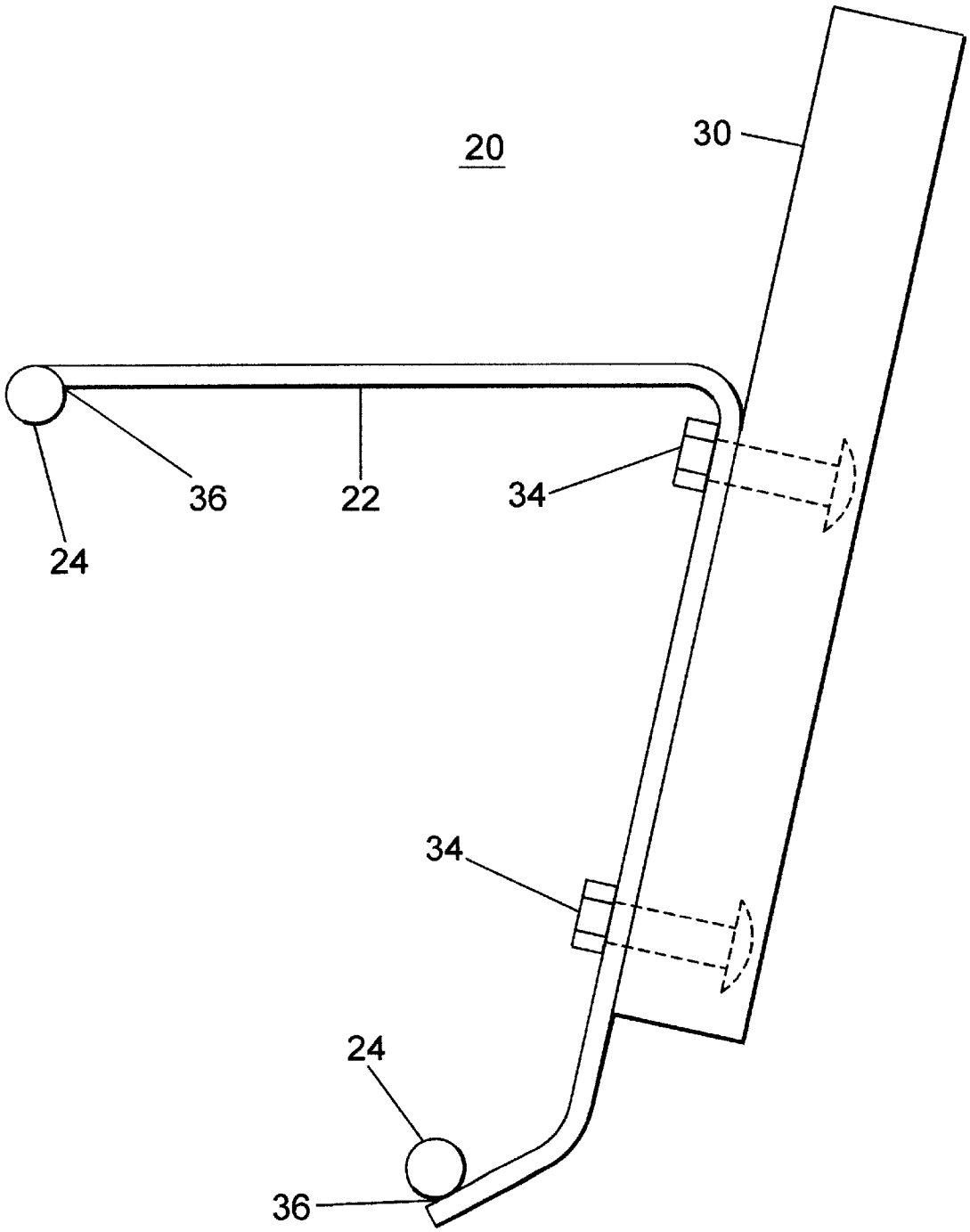
FIG. 3 is a side elevation view of the car including the outboard motor mounting board.
Figure 4:
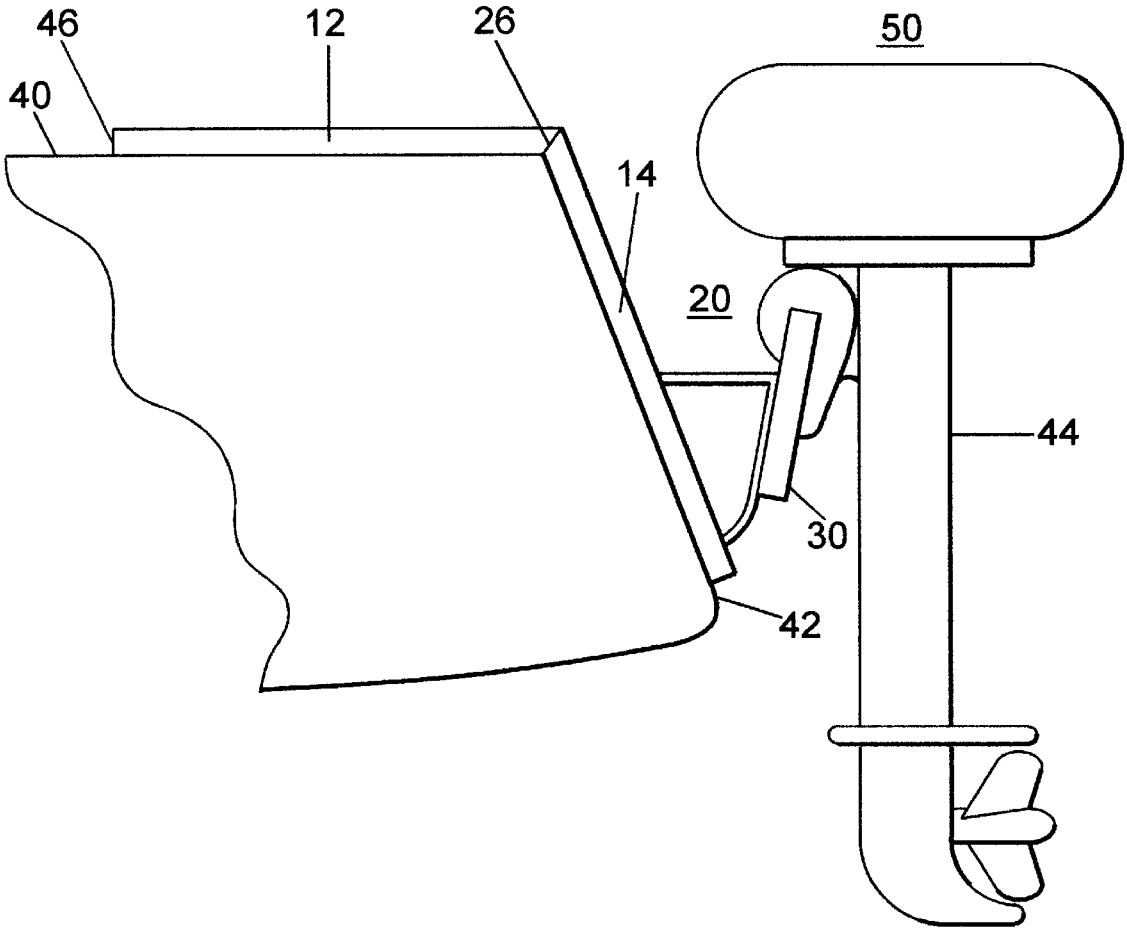
FIG. 4 is a side elevation view of the positioner with an outboard motor attached to the car shown in a marine propulsion operational position.

The first major component is a single two section track 12 and 14, made of a hard strong material suitable of supporting the intended load plus an appropriate safety factor. The track must keep containment of the second major component, a car 20. The track must facilitate travel for the car 20 and must also facilitate its change of direction and position. The track used for this invention is comprised of two sections 12 and 14 of an extrusion with a shape FIG. 2 that provides extremely parallel symmetrical channels 38 on each side. The adjacent ends 16 and 18 may be joined together to form a single continuous track. These channels provide captivation for axles 24 of the car 20. The nearly horizontal section of track 12 is adapted for mounting to the aft deck 40. The second section of track 14 is adapted for mounting to the transom 42. Additional sections of track may be used if needed, but all adjacent ends must match so that the car 20 can freely travel through all sections. A stop or bumper 28 is installed at the end of the second section of track 14 to support the major portion of the intended load while keeping the car 20 in the track.

The second major component, the car 20, consists of two parallel axles 24 affixed to a bracket 22 of proper size and shape to support an outboard motor mounting board 30. The ends of the two axles 24 may be covered with caps 32 made from a material that reduces friction, such that the car 20 slides easily through the entire length of track.

The third major component is an outboard motor mounting board 30. The outboard motor mounting board 30 is typically made from plywood, plastic or other similar material. It must be strong enough to support the load of the outboard motor plus any desired safety factor. It must also provide mounting holes for fasteners 34 for securing to the car 20.

Permanent or temporary fasteners may be added to the beginning 46 of the nearly horizontal section of track 12 to captivate the car 20 so that it will not slide out accidentally.

Operational use of this invention has shown that locking the car 20 in the bottom or end position is unnecessary. The weight of the motor adequately holds the car 20 in its operational position. Some users may opt for locking the car 20 at the lower end of the track or other positions. Holes may be drilled through either side of the track so that pins, bolts, padlocks or other objects can be placed through the sides of the track to lock or restrict car movement at any desired position.

Other materials or finishes may be utilized to improve performance or reduce cost as they become known or available.

Figure 5:
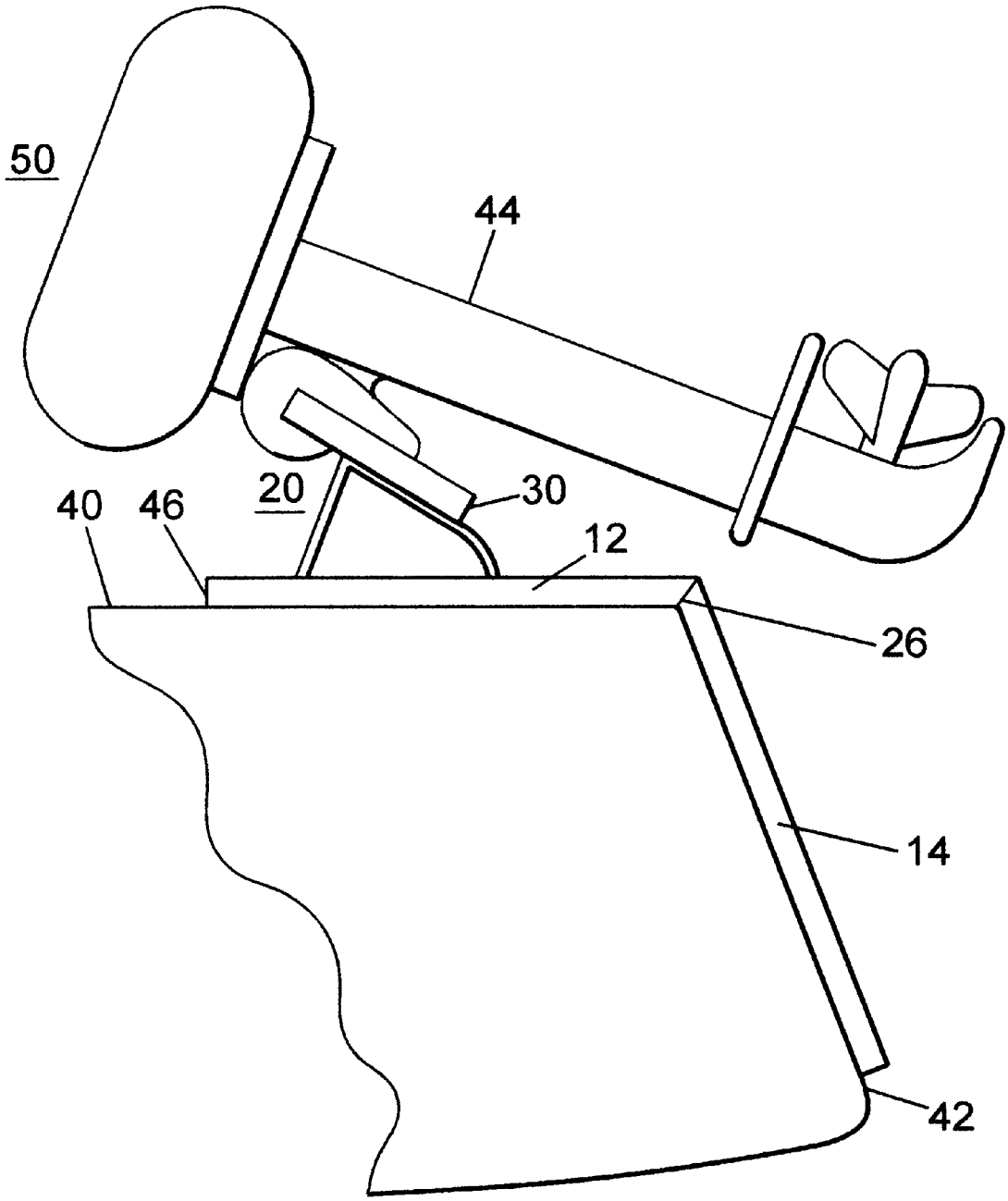
FIG. 5 is the same as FIG. 4, except the outboard motor attached to the car is in the on-deck position, the position for attaching or removing the outboard motor.

The manner and process of using a positioner follows:

An outboard motor 44 may be attached to the mounting board 30 on the car 20 either before or after inserting the car 20 into the start 46 of the nearly horizontal section of track 12. The inventor's preference is to attach the motor 44 to the mounting board 30 while the car 20 is in the nearly horizontal section of the track 12, FIG. 5. After attaching the outboard motor 44 to the mounting board 30 and tightening the outboard motor fasteners, the outboard motor 44 and the car 20 become one assembly 50. Slide the assembly 50 to the back of the boat and slowly slide it over the transom 42 until it rests on the stop 28 at the bottom of the track. The outboard motor 44 is now in position for normal marine propulsion operation. For removal and stowage, perform the opposite routine. Lift the assembly 50 up the track and onto the deck 40 to the start end of the track 46. Remove the outboard motor 44 from the outboard motor mounting board 30 and stow the outboard motor 44. Leave the now empty car 20 in the track or remove and stow it, whichever is preferred.

I claim:

1. An outboard motor positioner that supports, positions, and facilitates controlled spatial positioning of an outboard motor between a first position that is adjacent to and above a generally horizontal rear deck of a boat and a second position that is adjacent to and behind a transom of said boat, whereby the second position is a propulsion operating position, the positioner comprising:

a single, continuous track comprising first and second one-piece, straight sections that are joined at an angle and are adapted for mounting to said boat, the first section being above and generally parallel to said rear deck, the second section being behind and generally parallel to said transom, each of said sections having opposed channels;

a car comprising a motor mounting board, a bracket, and first and second axles, wherein said axles are connected to said bracket and said bracket is attached to said board, said board being adapted to support an outboard motor, said axles having low friction end caps, wherein said end caps are disposed in said channels such that said car is captured and moveable within said track.

2. The outboard motor positioner of claim 1, said track incorporates a stop at one end of said track, the end that when mounted to said boat is near the bottom of said transom, and an optional, removable stop at the opposite end of said track to prevent said car from sliding out when not desired.

* * * * *